United States Patent [19]

Dreizler et al.

[11] Patent Number: 4,926,765

[45] Date of Patent: May 22, 1990

[54] FURNACE BLOWER WITH EXTERNAL GAS RECYCLING FOR THE REDUCTION OF $NO_x$

[76] Inventors: Walter Dreizler, Brachetweg 16, 7000 Stuttgart 75; Ulrich Dreizler, Verenaweg 3, 7208 Spaichingen, both of Fed. Rep. of Germany

[21] Appl. No.: 334,738

[22] Filed: Apr. 4, 1989

Related U.S. Application Data

[63] Continuation of Ser. No. 39,072, Apr. 16, 1987, abandoned.

[30] Foreign Application Priority Data

Dec. 11, 1986 [DE] Fed. Rep. of Germany ..... 3642357

[51] Int. Cl.[5] ..... F23B 7/00

[52] U.S. Cl. ..... 110/234; 110/204; 431/115

[58] Field of Search ..... 110/203, 204, 260, 303, 110/234; 431/115, 171; 122/47, 51, 52, 75, 136 R, 149

[56] References Cited

U.S. PATENT DOCUMENTS

| | | | |
|---|---|---|---|
| 1,609,150 | 11/1926 | Breese, Jr. | 431/115 |
| 1,634,533 | 7/1927 | Breese, Jr. | 431/115 |
| 1,691,541 | 11/1928 | Carlson et al. | 431/115 |
| 1,702,936 | 2/1929 | Frenier | 431/115 |
| 1,831,529 | 11/1931 | Frenier | 431/115 |
| 2,224,544 | 12/1940 | Keller | 431/115 |
| 2,813,578 | 11/1957 | Ferguson | 110/260 X |
| 2,918,117 | 12/1959 | Griffin . | |
| 3,260,227 | 7/1966 | Daman et al. | 431/115 |
| 3,367,570 | 2/1968 | Reichmann | 431/115 |
| 3,460,519 | 8/1969 | Ospelt et al. | 122/149 |
| 3,741,166 | 6/1973 | Bailey | 431/116 X |
| 3,868,211 | 2/1975 | La Haye et al. | 431/115 X |
| 4,312,320 | 1/1982 | Jennings | 110/224 X |
| 4,725,223 | 2/1988 | Coppin et al. | 431/115 X |
| 4,728,282 | 3/1988 | May | 431/9 |

FOREIGN PATENT DOCUMENTS

OF2603988 2/1976 Fed. Rep. of Germany .

*Primary Examiner*—Edward G. Favors
*Attorney, Agent, or Firm*—Edwin E. Greigg

[57] ABSTRACT

A furnace system is provided with exhaust gas recirculation via a recirculation tube having an inlet mounted downstream of the furnace firing area and an inlet disposed in juxtaposition to the blower fan wheel of the furnace blower. The recirculated gases can enter the tube from either the stack or the firebox. The inlet penetrates the air intake plenum either axially thereof or at an angle thereto through a sidewall. The furnace includes both an air intake throttle and an air intake butterfly control valve. An exhaust gas recirculation control valve can be linked to the air intake control butterfly valve for their operation in concert. The air intake throttle is either a rigid baffle or a pivotable flap.

4 Claims, 2 Drawing Sheets

FURNACE BLOWER WITH EXTERNAL GAS RECYCLING FOR THE REDUCTION OF $NO_x$

This is a continuation of copending application Ser. No. 039,072 filed Apr. 16, 1987, now abandoned.

The invention relates to the reduction of $NO_x$ in gas and oil heating units which are equipped with a furnace blower. The subject of the invention is a new type of exhaust gas recycling system which permits recycling of part of the exhaust gas from the boiler area back to the furnace blower without any additional conveying devices and thus, in previously unknown economical ways, accomplished a sufficient reduction of the $NO_x$ content in the exhaust gas.

It is known that a reduction in $NO_x$ can be achieved in the firing area by recycling or recirculating exhaust gas. Applications are known in which an "internal" exhaust gas recirculation occurs from the firing area to the port-end. The injector effect of the fuel nozzle and-/or the injector effect of the combustion air, which is moved by the blower into the mixing area, serves as the "drive" for recirculating the flame gasses. As a result the temperature of the flame is reduced, e.g. from 1,600° C. to 1,500° C., which—while reducing the generation of $NO_x$ by 10 to 15 percent—still results in 100 ppm $NO_x$ which is far above the desirable maximum of less than 50 ppm $NO_x$. The slight reduction in partial pressure of the oxygen content in the combustion or flame zone which occurs during "hot" internal exhaust gas recirculation is also insufficient to achieve a satisfactory reduction of $NO_x$.

Exhaust gas recycling has also become known for large-scale power plants in which up to 25 percent of the exhaust gas is recycled back to the port-end of the furnace blower by special exhaust gas blowers through external exhaust gas conduits. Experience has shown that under such operational conditions the desired reduction of $NO_x$ to less than 50 ppm is possible. The disadvantage lies in the additional expense of acquiring and monitoring the exhaust blower (or blowers) and the constant additional operating expenses for electricity and maintenance.

OBJECT OF THE INVENTION

It is an object of the invention to provide a configuration of equipment that does not require an exhaust gas blower because other suitable means of moving a partial volume of exhaust gas are provided.

BRIEF DESCRIPTION OF THE DRAWINGS

FIGS. 1 and 2 represent examples of applications of the invention's construction of a furnace blower with external recycling of exhaust gas by which $NO_x$ is to be reduced to $<50$ ppm. The figures show a draw-in boiler 1 with a "hot" combustion chamber 2, exhaust gas return 3, exhaust gas connection piece 4 and exhaust pipe 5. Any other type commercial boiler, e.g. with two or three boiler draws, can also be operated with the furnace blower of the invention to achieve effective $NO_x$ reduction. Inside the firing area, designated 6, burns burner flame 7 of furnace blower 9 wherein said furnace blower 9 is constructed of the following major components: ventilation housing 10 with motor 11 and combustion air blower wheel 12; burner housing 13 with port-end 14 and fuel supply 15; as well as magnetic valve 16, gas adjustment butterfly valve 17, and other gas-security fittings; and furthermore burner flame tube 18. In an also known manner, air intake chamber 19—is tightly mounted at the entrance of inlet port 21 of ventilation housing 10. Air intake chamber 19—or, alternatively, air intake connection piece 20 upstream from said part 21 combustion air cross section 22 which is open toward the atmosphere. So far in the application examples of the invention shown in the figures we have been concerned with boiler and furnace blower designs which as such are known; these are provided with additional inventive characteristics which are described below.

FIG. 1 is a top view of a furnace blower in accordance with the invention with an infinitely variable, modulated operation wherein the boiler is shown in a sectional view taken along lines A–B at the level which shows the burner and exhaust gas connection piece. The furnace blower is shown therein sectionally at the level of aspirating port 21 of ventilating fan housing 10.

FIG. 2 is a side view of the gas furnace blower of the invention as seen from the outside with a partial view of the boiler. As was seen in FIG. 1, air intake chamber 19 is positively mounted in front of aspirating port 21 on ventilation housing 10; said chamber has an end 22, which is open to the atmosphere, at a right angle on the right side of aspirating port 21; said end 22 can be adjusted—in a generally familiar manner—depending on the modulating burner setting, at its air intake cross section by a movable air intake control butterfly valve **23*a* which is set by servomotor 36. Through adjustable air throttling disk 24*a*, located between air intake control butterfly valve 23*a* and blower wheel 12 in front of aspirating port 21, exhaust gas recirculation outlet 32*a*—leads from outside through wall 25 of air intake chamber 19 and continues through air throttling disk 24*a* into the air plenum 19 until the open end protrudes into the plane of blower wheel 12. At this point there is usually uniform low pressure, which is the optimal arrangement for any position assumed by the air intake control butterfly valve 23*a* and/or air throttling disk 24*a* to receive—some of the exhaust gas in exhaust gas recycling tube 35, whereby uniform distribution and mixing with combustion air is achieved in the area of blower wheel 12**. In this way it is possible to forego the use of a mechanical exhaust air moving device such as special exhaust gas blowers; this is the decisive characteristic of the current invention.

FIG. 1 shows the further design of air throttling disk **24*a*, which is arranged about exhaust gas recirculation outlet 32*a* by a flange 39 and movably positioned over threaded spindle 26 and control screw 27, so that aspirating port 21 can be preset. Air intake control butterfly valve 23*a* allows the actual adjustment of the temporary burner setting for an operational mode of the modulated furnace blower which is regulated by an electronic burner control device. There are conventional means indicated generally at 16, 17 used to provide the simultaneous control of fuel intake 15 over the composite linkages so no discussion thereof is deemed necessary. Connected to air intake control butterfly valve 23*a* by composite linkage 28*a*, is exhaust gas control butterfly valve 29, which—also in accordance with the invention—is positioned upstream within exhaust gas recycling system 35 outside of air intake chamber 19; said exhaust gas control butterfly valve 29 has the effect of adapting the partial exhaust gas volume to the air intake that is appropriate for the modulating burner setting. At higher burner settings—resulting also in higher air intake settings—the opening of exhaust gas control butterfly valve 29** is correspondingly wider, so that for this operational setting a larger volume of exhaust gas can be drawn and thus the exhaust gas ratio in the combustion air is sufficiently large to assure that the desired $NO_x$ reduction is achieved.

Figure 1:
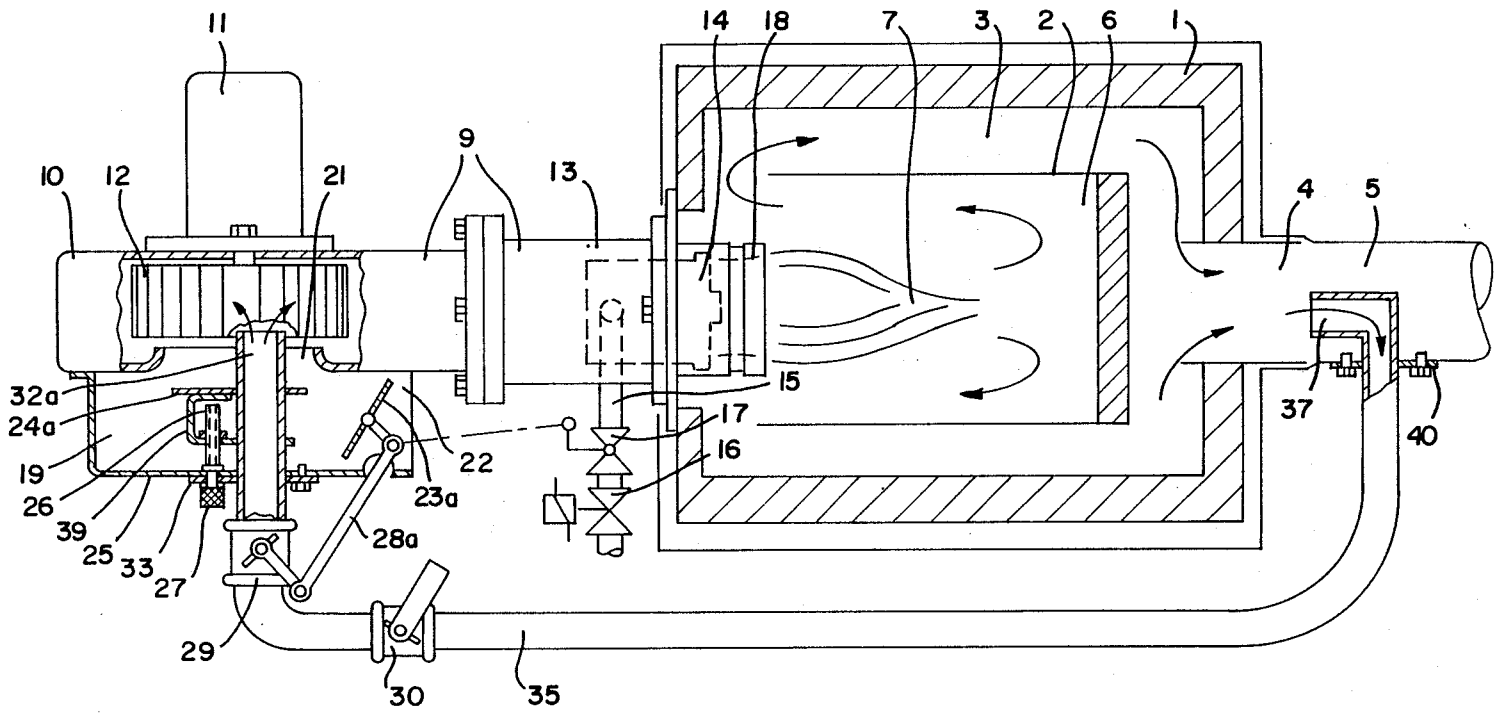
FIG. 1 is a sectional plan view of the furnace provided with the invention.
Figure 2:
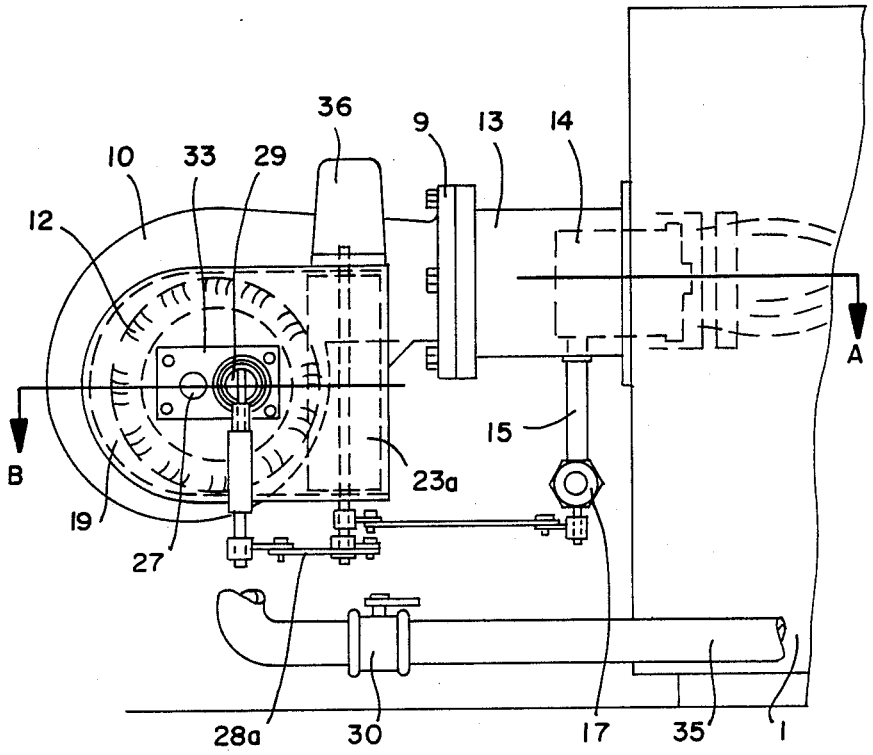
FIG. 2 is a sectional side view of the furnace of FIG. 1 rotated by 90° from that of FIG. 1.

On the other hand, exhaust gas control butterfly valve 29 effects, through its composite linkage 28*a*, a throttling of exhaust gas when the output and air requirements are lower to counteract higher manometric pressure which occurs in the area of blower wheel 12 at the open end of exhaust gas recycling system 32*a* when the opening of air intake control butterfly valve 23*a* is smaller.

Exhaust gas recycling system 32*a* is mounted on wall 25 of air intake chamber 19 with flange 33.

Exhaust gas control butterfly valve 30 can be adjusted by hand and is disposed upstream of exhaust gas control butterfly valve 29 within external (outside) exhaust gas recycling tube 35. It permits advance throttling of some of the exhaust gas volume independently of the adjustment of exhaust gas control butterfly valve 29.

Exhaust gas recycling system 35 is positioned outside and around boiler 1 and is provided with an inlet 37 which enters exhaust pipe 5 behind exhaust gas connection piece 4 of boiler 1, mounted on said exhaust pipe with flange 40. The inlet terminates at an angle—or, alternatively, curved—with its inlet end 37 pointing upstream. This serves to increase exhaust gas backpressure and thereby increases manometric pressure. Exhaust gas recycling system 35 is constructed completely or partially with rigid or flexible pipes.

In an alternative design the exhaust gas recycling system with its open end 38 is shifted, through the water-holding section of the boiler, to said boiler's rear exhaust gas channel. This modification causes even more cooling of the partial exhaust gas volume and permits a lower thermal load on the burner particles admitted by.

We claim:

1. In a furnace construction comprising a furnace blower provided with a motor, blower wheel, ventilation housing, portend and a flame tube which is adapted for modulating burner operation with a combined fuel and air control, an air intake chamber attached at a front end of an air intake opening of the ventilation housing, a servomotor-activated air intake control butterfly valve disposed inside the air intake opening of said air intake chamber, a manually adjustable air throttling disk downstream of said air intake opening of the ventilation housing adapted to reduce $NO_x$ by external recycling of exhaust gas through a pipe means characterized in that an exhaust gas recirculation tube is guided through an external wall of air intake chamber and terminates in close proximity to the blower wheel, means to support a flange relative to the exhaust gas recirculation tube for adjustment of an air throttling disk which is movable by means of a threaded spindle, the entrance of exhaust gas recirculation tube being positioned downstream of air throttling disk directly in the low pressure area of blower wheel.

2. In a furnace construction as claimed in claim 1, further characterized in that the exhaust gas recirculation tube is provided with an exhaust control butterfly valve upstream of the air intake chamber, said exhaust gas control butterfly valve being actuated through composite linkage by the servomotor-activated air intake control butterfly valve and further that, upstream of said air intake control butterfly valve, a manually operated exhaust gas control butterfly valve is disposed in said exhaust gas recirculation tube 32*b*.

3. In a furnace construction as claimed in claim 1, further characterized in that exhaust gas recirculation tube is adapted to enter a boiler area of the furnace through a water-circulating jacket thereof.

4. In a furnace construction as claimed in claim 1, further characterized in that a rigid throttling disk is disposed in the air intake chamber upstream of said exhaust gas recirculation tube.

* * * * *